US010870535B2

(12) United States Patent
Olness

(10) Patent No.: US 10,870,535 B2
(45) Date of Patent: Dec. 22, 2020

(54) VERTICALLY SELF-SUPPORTING TRASH BAG

(71) Applicant: Robert C. Olness, Stony Brook, NY (US)

(72) Inventor: Robert C. Olness, Stony Brook, NY (US)

( * ) Notice: Subject to any disclaimer, the term of this patent is extended or adjusted under 35 U.S.C. 154(b) by 0 days.

(21) Appl. No.: 15/096,676

(22) Filed: Apr. 12, 2016

(65) Prior Publication Data

US 2017/0291763 A1 Oct. 12, 2017

(51) Int. Cl.
*B65D 33/00* (2006.01)
*B65F 1/14* (2006.01)
*B65F 1/00* (2006.01)

(52) U.S. Cl.
CPC ..... *B65F 1/14* (2013.01); *B65F 1/0006* (2013.01); *B65F 2210/13* (2013.01); *B65F 2210/18* (2013.01); *B65F 2220/106* (2013.01); *B65F 2220/116* (2013.01); *B65F 2250/1146* (2013.01)

(58) Field of Classification Search
CPC ..... A45C 7/0081; A45C 7/004; B65D 81/052
USPC ..... 383/3, 22–25, 43–45, 71–77, 200, 383/203–205, 207–209, 100–103
See application file for complete search history.

(56) References Cited

U.S. PATENT DOCUMENTS 2,462,215 A * 2/1949 Norman ..... A45C 9/00 383/3
D234,751 S * 4/1975 Brodsky ..... 383/3
5,346,311 A * 9/1994 Siler ..... B65D 33/007 383/104
5,407,111 A * 4/1995 Lanouette ..... A45F 3/00 224/417
7,066,331 B2 * 6/2006 Koyanagi ..... B65D 81/052 206/522
7,201,273 B2 4/2007 Chen et al.
7,568,508 B2 8/2009 Liao et al.
7,631,762 B2 12/2009 Liao et al.
2002/0064319 A1 * 5/2002 Tanaka ..... B65D 33/02 383/3
2005/0232517 A1 * 10/2005 Reid ..... A45C 7/0059 383/2
2005/0284791 A1 * 12/2005 Sadow ..... B65D 81/052 206/522

(Continued)

OTHER PUBLICATIONS

"Gorilla Tough Self-Standing Bags" http://www.gorillatough.com/node/794.

*Primary Examiner* — Jes F Pascua
*Assistant Examiner* — Nina K Attel
(74) *Attorney, Agent, or Firm* — Nelson Mullins Riley & Scarborough LLP; Thomas J. Engellenner; Reza Mollaaghababa

(57) ABSTRACT

In one aspect, a trash bag is disclosed, which comprises a plurality of inflatable enclosures (herein also referred to as inflatable bladders) coupled to one another so as to form a vertically self-supporting structure when inflated, where the structure extends from a proximal end to a distal end to provide at least a portion of a perimeter wall of the trash bag. A deflation strip is coupled to at least one of the inflatable enclosures for deflating said enclosure after inflation. The trash bag further includes a floor coupled to the inflatable enclosures so as to provide, in combination with the vertically self-supporting structure, a container for receiving trash.

27 Claims, 9 Drawing Sheets

(56) References Cited

U.S. PATENT DOCUMENTS

| | | | | |
|---|---|---|---|---|
| 2009/0274395 | A1* | 11/2009 | Orion | A45C 7/0081<br>383/3 |
| 2011/0103718 | A1* | 5/2011 | Bosman | B65D 75/008<br>383/66 |

* cited by examiner

VERTICALLY SELF-SUPPORTING TRASH BAG

BACKGROUND

The present invention relates generally to a vertically self-supporting bag, which can be used in a variety of different ways, e.g., as a container for refuse.

Trash bags are ubiquitous. Plastic trash bags are conventionally used to line the inner surfaces of trash receptacles. Trash bags allow sanitary collection and disposal of waste. Despite many improvements in design and fabrication of conventional trash bags, there is still a need for providing improved trash bags.

SUMMARY

In one aspect, a trash bag is disclosed, which comprises a plurality of inflatable enclosures (herein also referred to as inflatable bladders) coupled to one another so as to form a vertical structure (e.g., a vertically self-supporting structure) when inflated, where the structure extends from a proximal end to a distal end to provide at least a portion of a perimeter wall of the trash bag. A deflation strip is coupled to at least one of the inflatable enclosures for deflating the enclosure after inflation. The trash bag further includes a floor coupled to the inflatable enclosures so as to provide, in combination with the vertically self-supporting structure, a container, for example, for receiving trash.

In some embodiments, the inflatable enclosures are joined to one another by a plurality of seams (e.g., fused seams) such that each enclosure is joined to an adjacent enclosure by one of those seams. Each inflatable enclosure (bladder) is formed of an inner wall and an outer wall that are joined together by a plurality of seams. For example, the inflatable enclosures can be formed by joining two pieces of a fabric (e.g., a polymeric fabric) together by a plurality of seams such that one of those fabrics forms an inner wall of the inflatable enclosures and the opposed fabric forms an outer wall of the enclosures.

The trash bag can further include a plurality of one-way inflation valves each of which is fluidly coupled to one of the inflatable enclosures. The trash bag can also include a gas inflation channel that is fluidly coupled, via the one-way valves, to the inflatable enclosures for introducing a gas (typically air) into those enclosures. A gas inflation inlet port is fluidly coupled to the gas inflation channel so as to allow introducing a gas (typically air) into that channel, and via that channel, into the inflatable enclosures.

The deflation strip is configured to tear a hole in the inflatable enclosure(s) to which it is coupled, when pulled, so as to allow the gas contained in that enclosure(s) to exit, thereby deflating the enclosure(s).

In some embodiments, the trash bag further includes a draw string for closing the trash bag. Further, in some embodiments, the trash bag can include at least one strap that is configured for securing the trash bag to an external object, e.g., to anchor the trash bag in place. In some cases, a clip can be coupled to an end of the strap, the clip being further attachable to the strap at another location so as to form a loop having an adjustable size for securing the trash bag to the external object.

In some embodiments, the inflatable enclosures are configured to withstand an inflation pressure in a range of about 12 psi to about 14 psi.

A trash bag according to the present teachings can have a variety of different sizes. For example, the inflatable enclosures can have a height equal to or less than 150 cm in a non-inflated state, though other sizes can be employed. More generally, a trash bag according to the present teachings can be fabricated at a variety of sizes depending, e.g., on the desired application. For example, in some cases, the trash bag in a deflated state can have a height of about 150 cm and a width of about 150 cm and can have a height of about 110 cm and a width of about 200 cm in an inflated state, though in other embodiments, the height and the width of the trash bag can be different to suit a particular application.

In a related aspect, a trash bag is disclosed, which includes a plurality of gas-filled columns coupled to one another and extending from a proximal end to a distal end so as to form at least a perimeter wall of the trash bag surrounding an enclosure for receiving refuse. The trash bag further includes a gas inflation channel that is fluidly coupled to the gas-filled columns via a plurality of one-way valves, and a gas-inflation valve that is coupled to the gas-inflation channel for introducing a gas into the channel. The gas-filled columns can be vertically self-supporting and can be connected to one another by a plurality of seams. A deflation strip is coupled to at least a subset of the gas-filled columns for deflating that subset of the columns by generating tears therein, when pulled. By way of example, the deflation strip can be coupled to one or more of the gas-filled columns via a plurality of fused spots. The deflation strip can be disposed below the gas-inflation valve.

In some cases, the gas inflation channel is substantially orthogonal to the plurality of gas-filled columns. The gas-filled columns can be configured to withstand an operational pressure in a range of about 12 to about 14 psi and can have a height equal to or greater than about 1 meter.

In some embodiments, the trash bag includes a draw string for closing off the trash bag. A channel, which can be disposed above the gas-inflation channel, can provide a housing for the draw string. By way of example, the draw string channel can be fused (e.g., via a heat seal) to the gas-inflation channel. A portion of the draw string can be exposed outside the channel that houses the draw string to allow a user to pull the draw string for closing the trash bag.

In some embodiments, a vertical extension portion extends from the distal ends of the gas-filled columns to a floor of the trash bag.

Further understanding of various aspects of the invention can be obtained by reference to the following detailed description in conjunction with the associated drawings, which are described briefly below.

DETAILED DESCRIPTION

Figure 1:
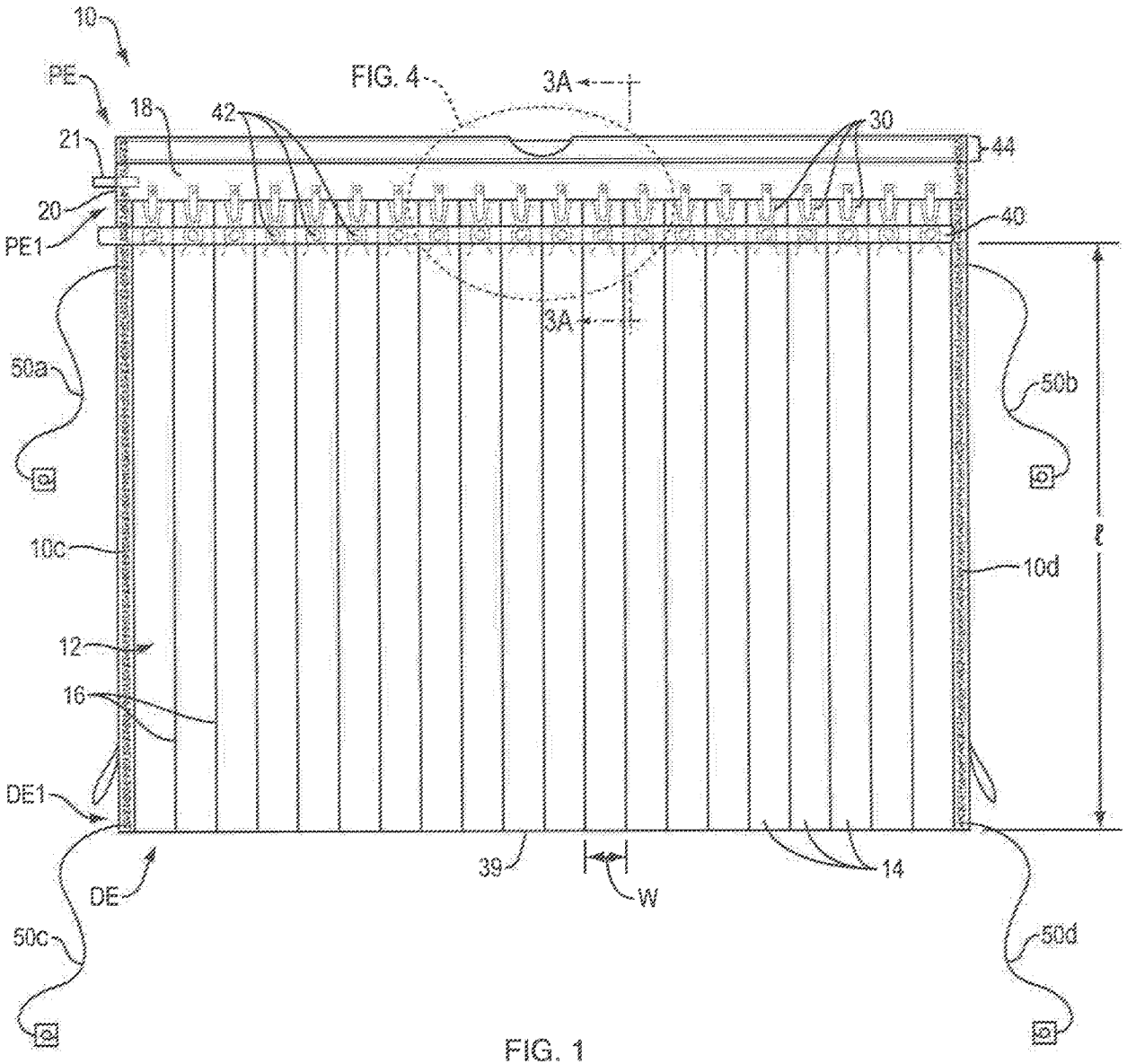
FIG. 1 is a schematic view of a trash bag according to an embodiment of the present teachings.

The present invention generally relates to an inflatable bag that includes a plurality of gas-inflatable bladders that can be easily inflated and can be readily deflated via a deflation strip. The inflation of the bladders results in forming a vertically self-supporting bag that can be used for a variety of different purposes. Although in the embodiments disclosed below the bag is described as a trash bag for receiving refuse, an inflatable bag according to the present teachings can be used for other purposes as well. The various terms are used herein consistent with their ordinary meanings in the art. The term "about" as used herein to modify a numerical value is intended to indicate a variation of at most 5% around that numerical value.

FIGS. 1, 3A, 6 and 7 schematically depict a trash bag 10 according to an embodiment, which includes a body 12 that extends from a proximal end (PE) to a distal end (DE) and has a plurality of inflatable enclosures 14 (herein also referred to as inflatable bladders 14), which are connected together to collectively form a portion of the trash bag body. In this embodiment, the trash bag 10 includes 20 inflatable bladders, though other numbers of inflatable bladders can also be employed, e.g., based on desired application, manufacturing constraints, etc. In this embodiment, each inflatable bladder is separated from an adjacent inflatable bladder by a seam, such as heat weld seams 16, that connect an outer layer 10*a* of the trash bag to an inner layer 10*b* thereof. Further, a plurality of seams 10*c* and 10*d* (e.g., formed via heat sealing) connect two portions of the trash bag to one another. By way of example, in this embodiment, each inflatable bladder can have an uninflated width (w), for example, in a range of about 3 cm to about 5 cm, and a height (l), for example, less than about 150 cm in a non-inflated state.

Figure 6:
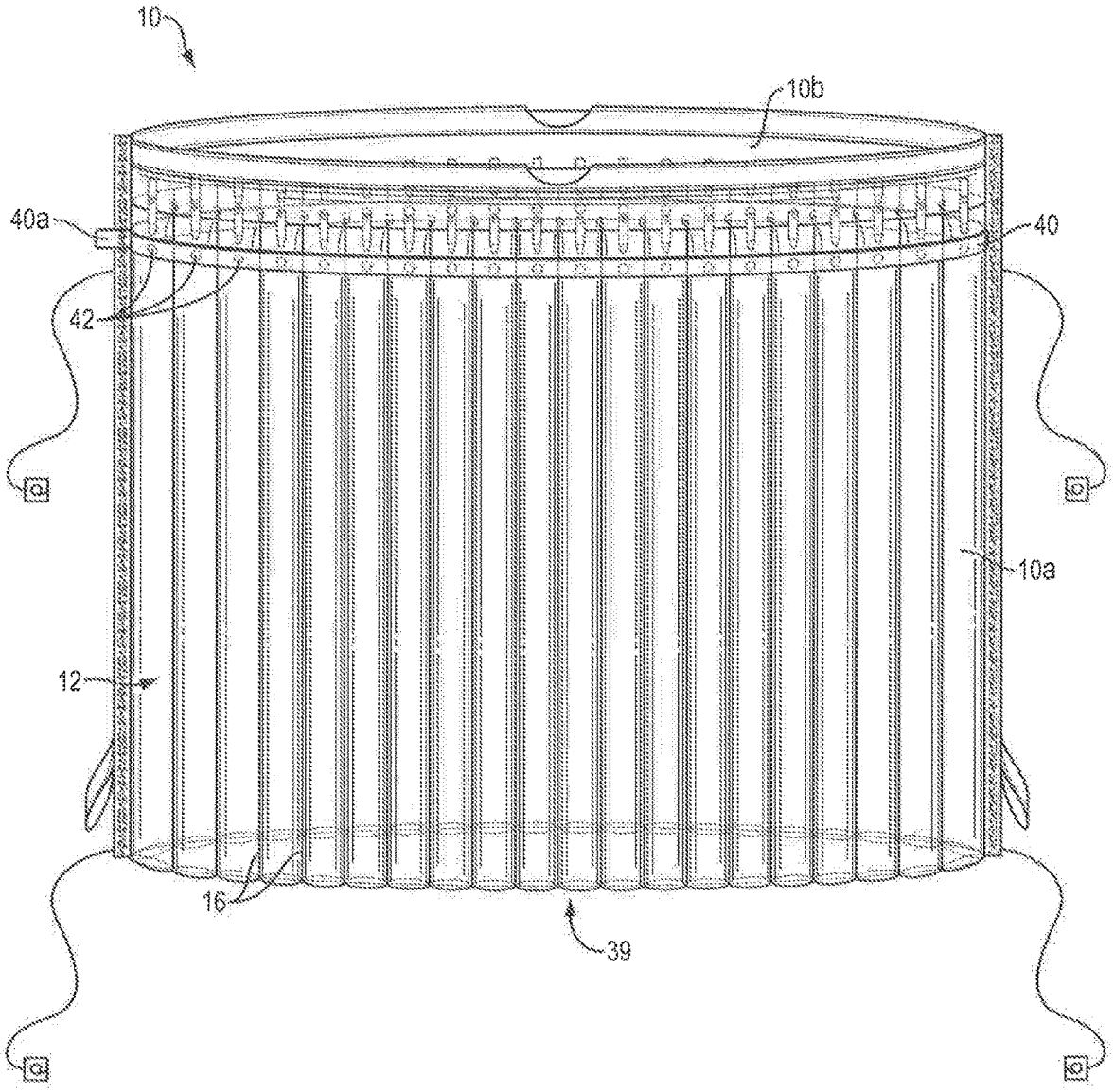
FIG. 6 is a perspective view of the trash bag of FIG. 1 in an inflated state.
Figure 7:
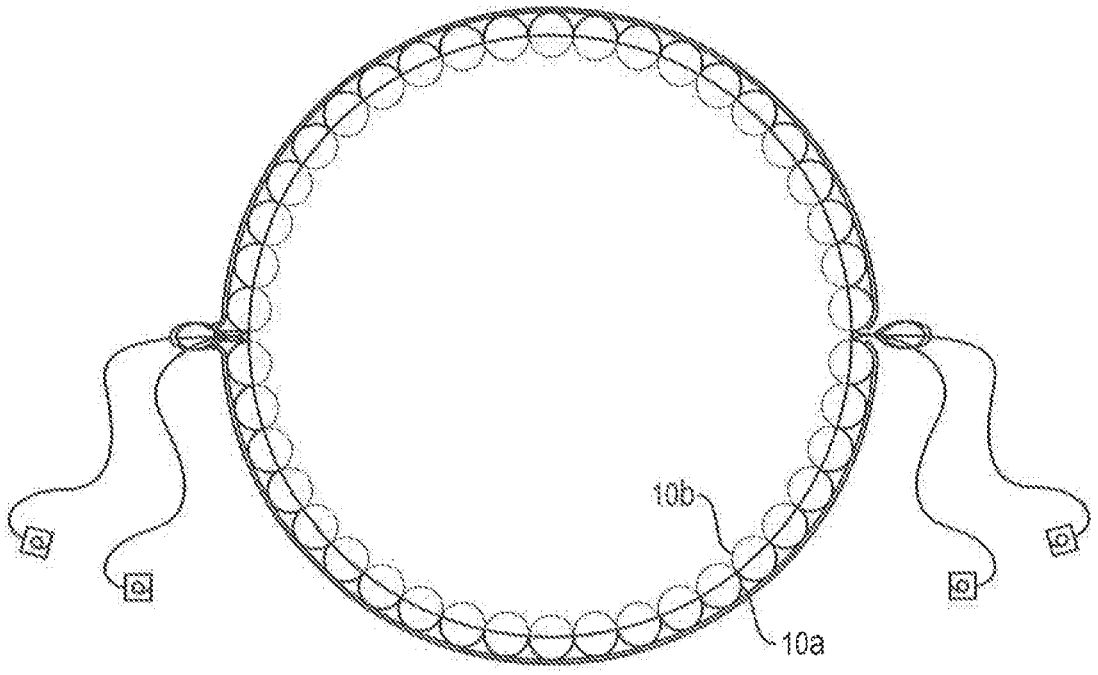
FIG. 7 is a top view of the trash bag depicted in FIG. 1, FIG. 8 schematically depicts that a deflation strip of a trash bag according to the present teachings can be pulled to puncture holes in the inflatable bladders to allow the gas (e.g., air) stored in the bladders to escape, thereby deflating the bladders, FIG. 9 schematically depicts an embodiment of a trash bag according to the present teachings having four handles for facilitating the transport of the trash bag, FIG. 10 schematically depicts a clip disposed at the distal end of a strap of the trash bag for securing the trash bag to an external object, FIG. 11 schematically depicts securing a trash bag according to the present teachings to an external anchor in the form of a peg.

As shown in FIG. 6, once inflated, the inflatable bladders 14 form collectively a cylindrical structure that extends from a proximal end PE1 to a distal end DE1 and that is vertically self-supporting and provides an enclosure for receiving, for example, refuse. In other words, the cylindrical structure can stand on a surface in a vertical orientation without a need for any supporting structure, e.g., a receptacle.

Figure 5:
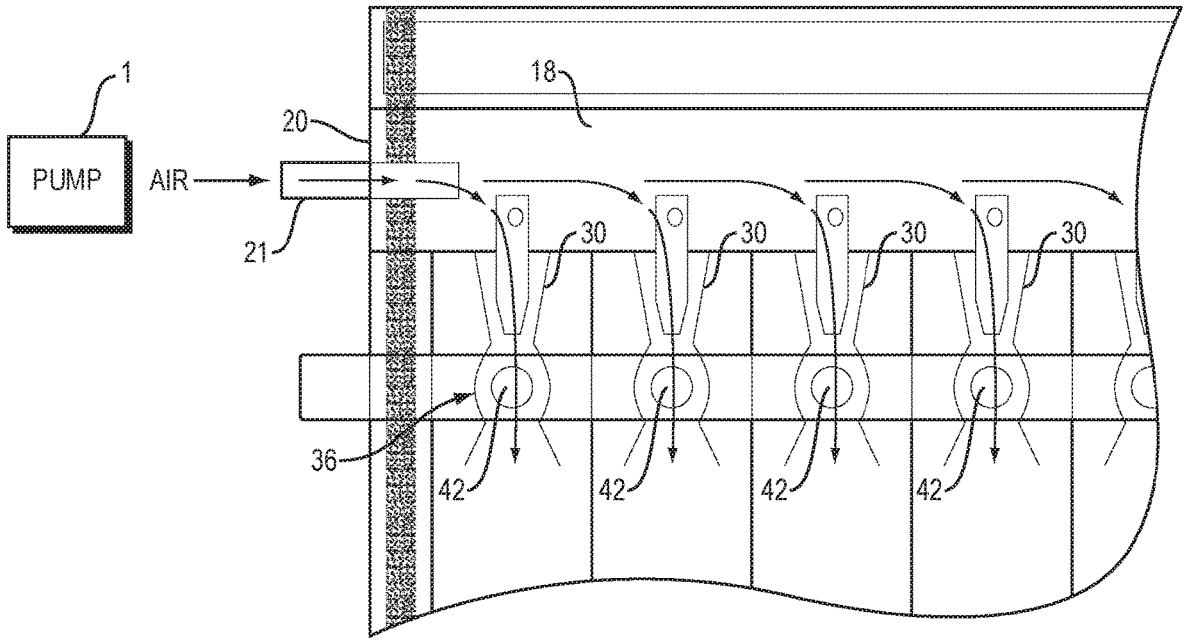

Referring again to FIG. 1 as well as FIG. 5, the trash bag 10 further includes a gas-inflation channel 18 (herein also referred to as an air channel) for receiving a gas (e.g., air). As discussed in more detail below, the air channel 18 is in fluid coupling, via a plurality of one-way valves, with the inflatable bladders 14. The air channel 18 includes an inlet port 20 for receiving a gas (typically air) from an external source, e.g., a pump 1. In some embodiments, a valve 21 (e.g., a one-way valve) can be coupled to the inlet port 20 to allow introducing a gas, for example, air from a pressurized source, into the air channel 18. The gas can then be introduced via the air channel into each of the inflatable bladders 14.

Figure 3A:
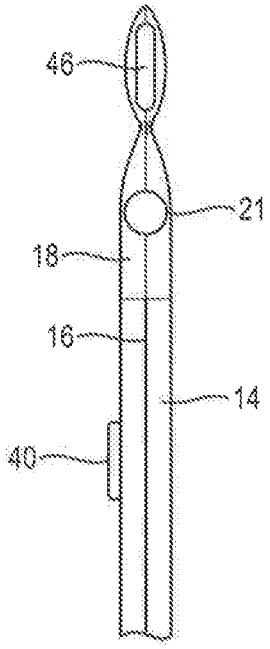
FIG. 3A is a schematic cross-sectional view of the trash bag shown in FIG. 1, FIG. 3B schematically depicts one of the inflatable bladders having a one-way valve for receiving a gas (e.g., air) from an air channel of the trash bag.
Figure 3B:
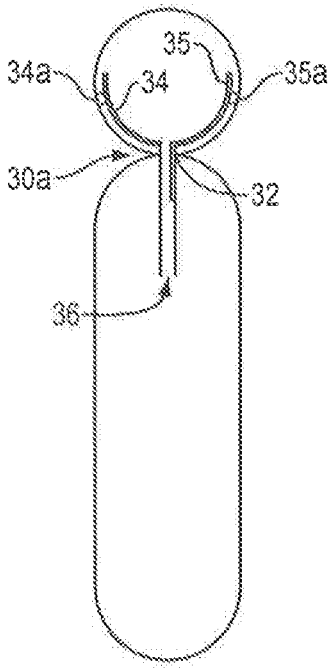

More specifically, with reference to FIGS. 1 and 5, a plurality of one-way valves 30 provide a one-way gas passage between the air channel 18 and each of the inflatable bladders 14. A variety of one-way valves can be employed. With reference to FIG. 3B as well as FIG. 5, in this embodiment, a one-way valve 30*a* associated with each of the inflatable bladders provides an air ingress hole 32 that fluidly couples the air-channel 18 with the respective inflatable bladder. Inner layers 34 and 35 are heat sealed, respectively, via transverse seals 34*a* and 35*a* to the wall of the air channel 18, where at least one of the inner layers 34 and 35 extends partially into the respective inflatable bladder. Once the air pressure within the inflatable bladder reaches a desired value, the air pressure within the bladder causes the inner layer 34 and/or 35 to close the air ingress hole 32.

With continued reference to FIG. 3B as well as FIG. 5, in this embodiment, an air passage 36 is disposed within each of the inflatable bladders with one end coupled to the air ingress hole 32 and the other end suspended within the inflatable bladder. As the air pressure inside the inflatable bladder increases the air passage 36 narrows, thus inhibiting air escape. Further details regarding a one-way valve suitable for use in the practice of the present invention can be found in U.S. Pat. No. 7,568,508, which is herein incorporated by reference in its entirety.

With reference to FIGS. 1 and 6, the trash bag 10 further includes a floor 39 that is coupled to the distal ends of the inflatable bladders 14 so as to form an enclosure, when the bladders are inflated, for receiving, for example, refuse.

Figure 8:
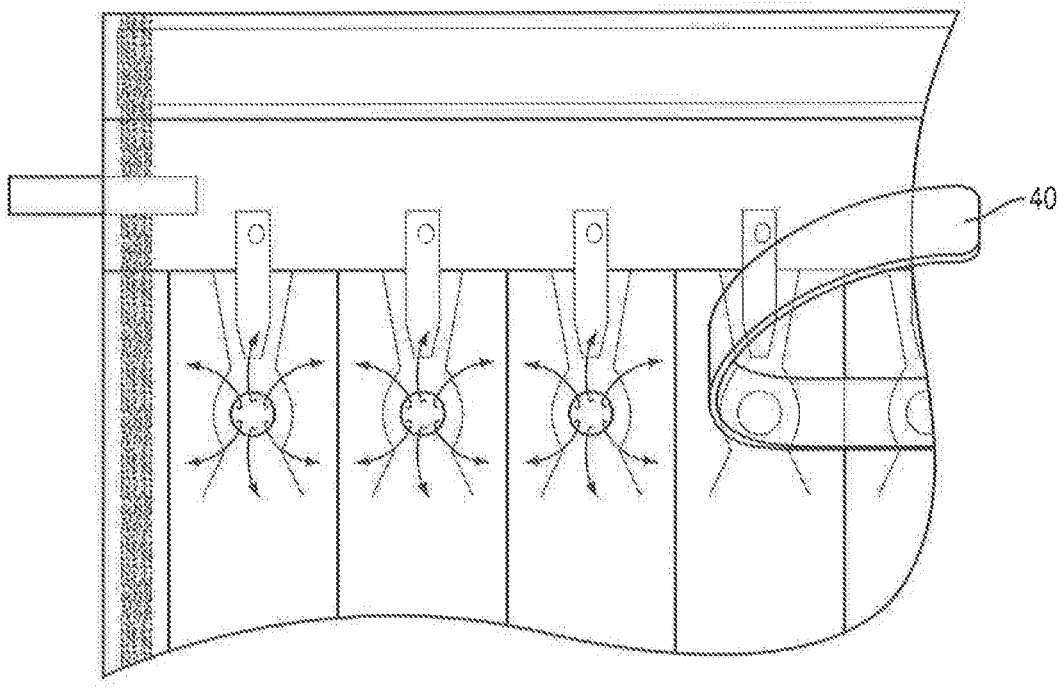

Referring to FIGS. 1, 6, and 8, the trash bag 10 further includes a deflation strip 40 that is coupled to the plurality of the inflatable bladders 14 via a plurality of breakable fused spots 42. For example, during the manufacturing process, the deflation strip 40 can be attached to a portion of the outer surface of the trash bag using heat weld at a plurality of spots to form the fused sports 42. In this embodiment, the maximum diameter of the fused spots can be, for example, in a range of about 2 to about 3 millimeters (mm). The deflation strip 40 further includes a tab 40*a* that allows a user to pull on the strip. As shown schematically in FIG. 8, the deflation strip 40 can be pulled so as to break the prescored breakable attachments between the deflation strip 40 and one or more of the inflatable bladders so as to tear holes in the walls of those bladders, thereby allowing the gas (e.g., air) contained in the bladders to escape to the external environment and hence deflating the bladders. In some embodiments, the deflation strip can be formed of a polymeric material, such as high density polyethylene (HDPE), and bonded to selected spots on the outer surfaces of the walls of the bladders using any suitable method, e.g., heat bond, heat seal, heat weld, heat fuse, sonic fuse, or using adhesives such as glue. The attachment of the deflation strip to the bladders is sufficiently strong such that the breakage of the fused spots between the deflation strip and the bladders, e.g., by pulling on the tab 40*a*, results in generating a tear in the bladders' walls.

Figure 4:
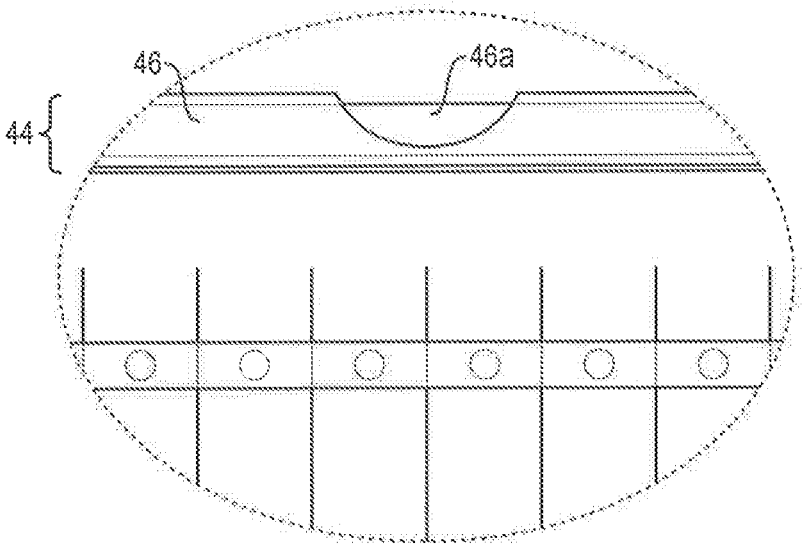
FIG. 4 is a partial view of a top portion of the trash bag depicted in FIG. 1 showing a draw string that can be used to close off the bag, FIG. 5 schematically shows the flow of air from an air inflation port through an air channel, and via a plurality of one-way valves, into a number of inflatable bladders of the trash bag.

Referring to FIG. 1 as well as FIG. 4, the trash bag 10 further includes an upper portion 44 that provides a channel in which a draw string 46 is disposed. A portion 46*a* of the draw string is exposed so that a user can pull on this portion for closing the opening of an enclosure generated by the inflated bladders. In some embodiments, the upper channel 44 is coupled to the air channel 18 via a heat seal.

Figure 10:
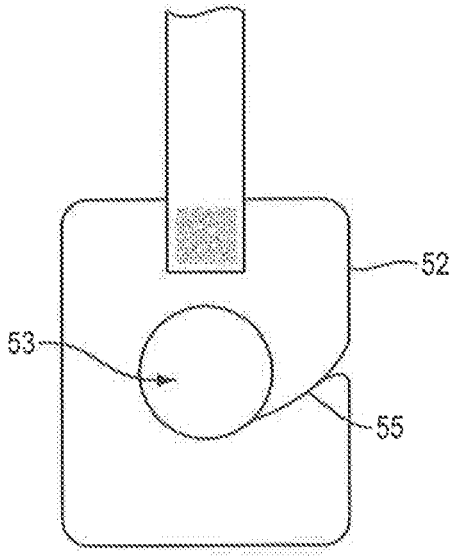
Figure 11:
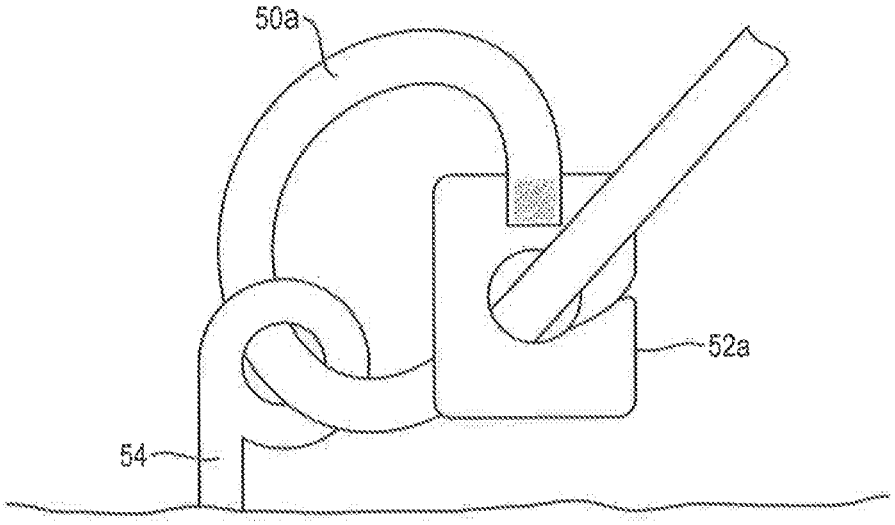

As shown in FIGS. 1 and 6, in this exemplary embodiment, the trash bag 10 further includes four straps 50*a*, 50*b*, 50*c*, and 50*d* (herein referred to collectively as straps 50) that are configured for securing the trash bag to an external object so as to anchor the trash bag in place. As shown in FIG. 10, each of the straps 50 is terminated in a clip 52, which can be in the form of a flat plate having an opening 53 and a slit 55 extending from its edge to the opening. The slit 55 allows a portion of the strap to be pushed into the opening to form a loop for securing the trash bag to an external anchor. For example, as shown in FIG. 11, in use, each of the straps 50 can be secured to a respective anchor. For example, in this embodiment, the strap 50*a* can be pulled through an opening of a peg 54 and secured to a clip 52*a* associated with the strap 50*a*. By way of example, when the trash bag is used on a beach, one or more pegs, similar to the peg 54, can be pressed into the sand to provide one or more anchors to which the trash bag can be secured, for example, to prevent it from being blown away by wind.

Figure 9:
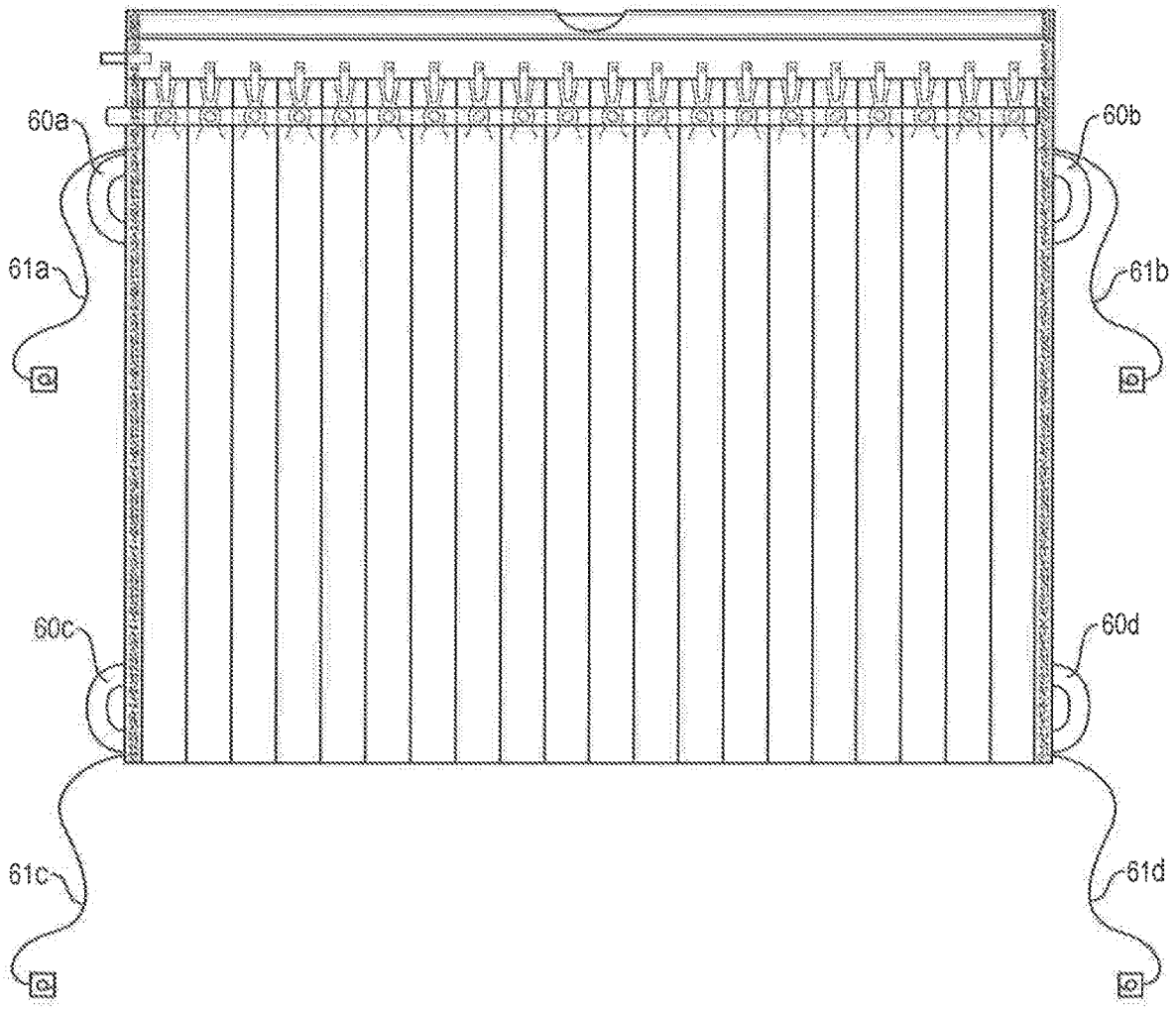

With reference to FIG. 9, in some embodiments, the trash bag further includes four handles 60*a*, 60*b*, 60*c*, and 60*d*, two of which are attached to the body of the trash bag in proximity of its proximal end and the other two in proximity of its distal end to facilitate carrying of the trash bag by a user. Further, in this embodiment, each of a plurality of tie-down straps 61*a*, 61*b*, 61*c*, and 61*d* extends from a respective handle and terminates in a clip, similar to the clip 52 discussed above.

The trash bag 10 can be formed of a variety of different materials. In some embodiments, the trash bag can be formed of a variety of different polymeric materials, such as polyolefins, e.g., low density polyethylene (LDP) and high density polyethylene (HDP). For example, the deflation strip can be formed of high density polyethylene (HDP) and the inflatable bladders, and other portions of the trash bag, can be formed of LDP. In some embodiments, the trash bag is fabricated using a polymeric material, such as polythyelene, that is substantially transparent to visible radiation such that the content of the trash bag would be readily visible, e.g., for inspection. In some embodiments, a trash bag according to the present teachings can be formed of a recyclable and/or biodegradable material. By way of example, in some embodiments, the trash bag can be formed of oxo-biodegradable plastic that is designed to degrade via photo-oxidation and thermo-oxidation.

By way of example, the trash bag 10 can be fabricated by joining two polymeric layers along a plurality of seams (e.g., via heat sealing) to form various compartments of the trash bag, including the inflatable bladders 14. As noted above, inner layers 34 and 35 can be coupled to the inner wall of the air channel via a plurality of transverse seals. The channel for housing the draw string can be fused to the upper portion of the air channel 18. The trash bag 10 can be fabricated manually or using an automated machine process. For example, in one method of fabricating the trash bags, the inflatable bladders are fabricated and fused together using, e.g., commercial heat irons. The air channel can then be fused to the top of the bladders, and the drawstring channel can be fused to the top of the air channel. The floor can then be bonded to the bottom of the inflatable bladders.

In use, the trash bag can be inflated by introducing a gas (typically air) into the plurality of inflatable bladders 14. By way of example, air can be introduced into the air channel 18 via its air inflation port. The introduction of air into the air channel 18 can be achieved in a variety of different ways. For example, a pump can be employed to introduce air at an elevated pressure into the air channel 18. Alternatively, a user can blow air into the air channel 18 via the inflation inlet port 21. The air from the air channel passes through the one-way valves 30 to reach the inflatable bladders and inflate those bladders by applying pressure to their walls. In some embodiments, the inflatable bladders can be inflated to a pressure in a range of about 12 to about 14 psi.

Once inflated, the trash bag is vertically self-supporting and can be used in a variety of different environments. For example, in some applications, the trash bag can be used in a residential unit for collecting garbage. In another application, the trash bag can be used in an industrial setting. In yet other applications, the trash bag can be used in an outdoor environment, e.g., on a beach, outdoor recreational facilities, etc. As discussed above, the draw string can be used to close off the upper opening of the trash bag, and the handles 60*a*/60*b*/60*c*/60*d* can be used to facilitate carrying the trash bag from one place to another.

If a user desires to deflate the trash bag, e.g., after it has been filled with refuse, the user can pull on the deflation strip 40, by pulling on its tab 40*a*, to tear holes in the walls of the inflated bladders to allow air (or other gas) to escape from the bladders to the external environment, thereby deflating the bag.

Figure 2:
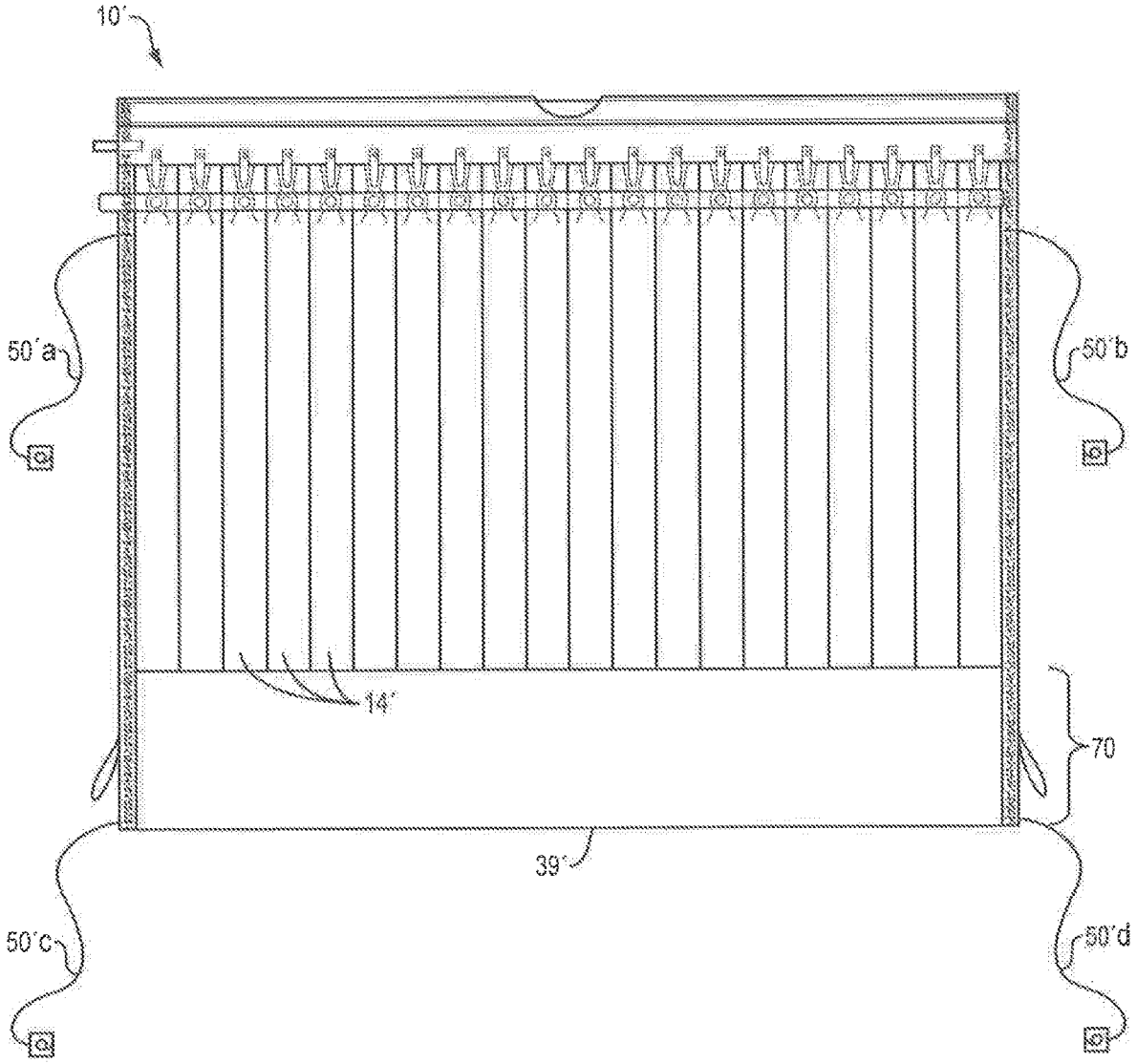
FIG. 2 is a schematic view of another embodiment of a trash bag according to the present teachings.

While in the above embodiment, the distal ends of the bladders are attached directly to the trash bag's floor, in other embodiments, the trash bag can include an extension portion disposed between the distal ends of the inflatable bladders and its floor. By way of example, FIG. 2 schematically depicts a trash bag 10' according to such an embodiment, which includes all of the features of the above trash bag 10 including a plurality of inflatable bladders 14'. In addition, in this embodiment, an extension portion 70 extends between the distal ends of the inflatable bladders 14' and a floor 39' of the trash bag. In some embodiments, the use of the extension portion 70 allows obtaining a desired height for the trash bag. Similar to the previous embodiments, the trash bag 10' includes a plurality of tie-down straps 50'*a*, 50'*b*, 50'*c*, and 50'*d*.

Figure 12:
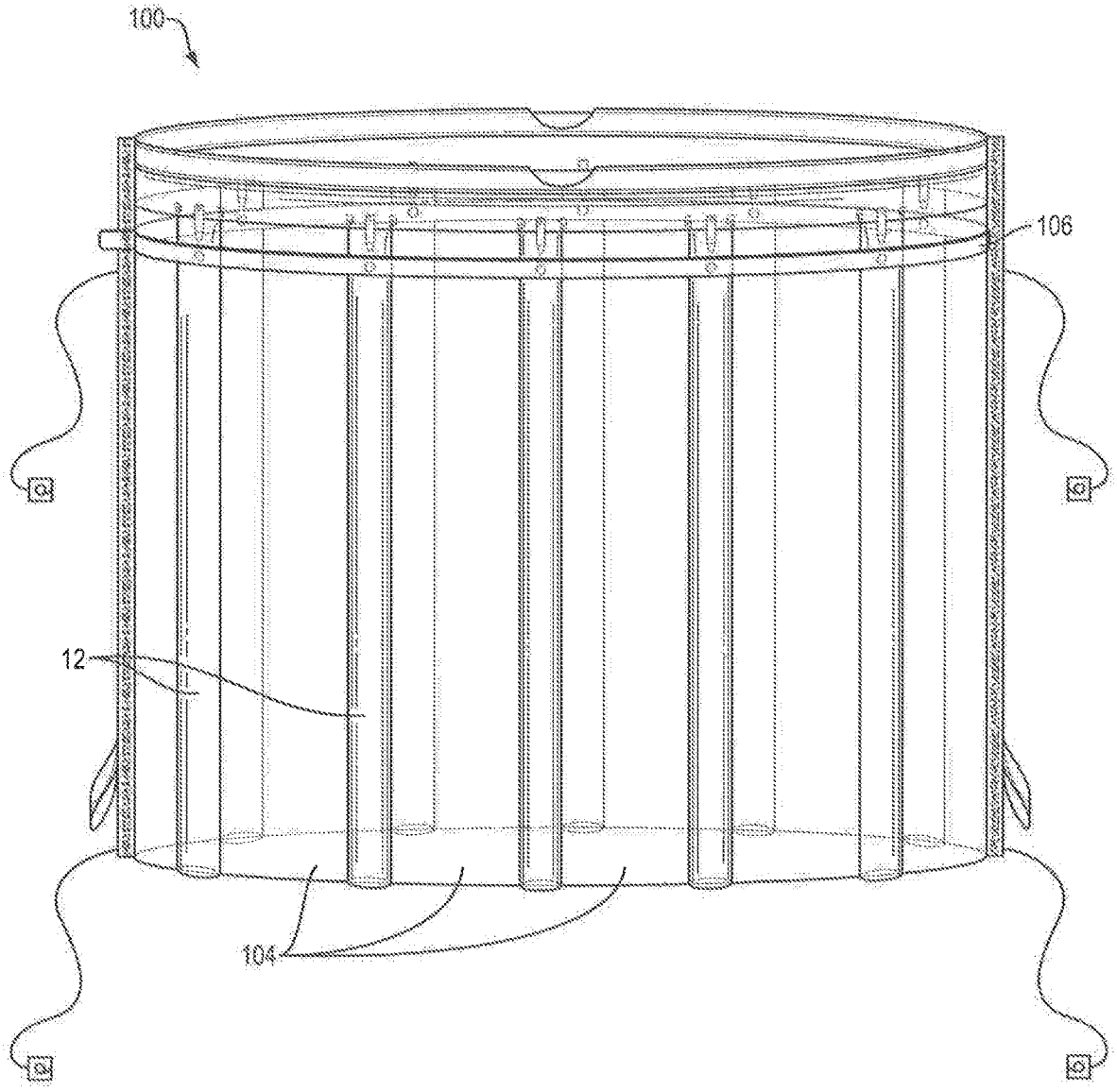
FIG. 12 is a partial schematic view of a trash bag according to an embodiment of the present invention.

In some embodiments, a trash bag according to the present teachings can include a plurality of inflatable bladders that are separated from one another by non-inflatable segments of the trash bag. By way of example, FIG. 12 schematically depicts a partial view of a trash bag 100 according to such an embodiment, which includes a plurality of inflatable bladders 102 that are separated from one another by non-inflatable portions 104 of the trash bag. In an inflated state, the bladders 102 can provide a vertically self-supporting structure. The bladder 102 and the portions 104 collectively form a perimeter wall of the trash bag. Similar to the previous embodiments, the trash bag 100 includes a deflation strip 106 that is coupled to the inflatable bladders and is configured such that it can be pulled so as to generate tears in the inflatable bladders, thereby allowing the gas contained in the bladders to escape. Though not shown in FIG. 12, the trash bag 100 can also include an air channel, which is fluidly coupled to the inflatable bladders via a plurality of one-way valves. Other features of the above embodiments, such as, a floor, a draw string for closing off the trash bag can also be implemented in the trash bag 100. Those having ordinary skill in the art will appreciate that various changes can be made to the above embodiments without departing from the scope of the invention.

What is claimed is:

1. A bag comprising:

a plurality of independent inflatable enclosures, the plurality of independent inflatable enclosures being coupled to one another and configured to collectively form a vertical structure that extends from a distal end of the bag to a proximal end of the bag upon inflation of the enclosures;

a floor coupled to said inflatable enclosures at the distal end of the bag such that said inflatable enclosures are, once inflated, substantially perpendicular to the floor and form, in combination with the floor, a vertically self-supporting container; and a deflation strip coupled to at least one of the inflatable enclosures on an outer surface of the bag and configured to deflate the at least one inflatable enclosure, after inflation, by generating a tear in the at least one inflatable enclosure.

2. The bag of claim 1, wherein the floor is configured to provide, in combination with said vertical structure, a container for receiving trash.

3. The bag of claim 1, further comprising a gas channel fluidly coupled to said inflatable enclosures for introducing a gas into said enclosures.

4. The bag of claim 3, further comprising an inflation valve fluidly coupled to said air channel for introducing the gas into the gas channel.

5. The bag of claim 4, further comprising at least one one-way valve coupled to at least one of the plurality of enclosures to allow passage of the gas from said gas channel into said enclosures.

6. The bag of claim 1, wherein the deflation strip is configured to generate the tear in the at least one inflatable enclosure, in response to being pulled, to allow gas contained in said enclosures to exit.

7. The bag of claim 1, further comprising a draw string for closing the bag.

8. The bag of claim 1, further comprising a strap configured to secure said bag to a location on an external object.

9. The bag of claim 8, further comprising a clip coupled to one end of said strap, the clip being further attachable to the strap at another location on the external object so as to form a loop having an adjustable size for securing said bag to the external object.

10. The bag of claim 1, wherein said enclosures are joined to one another by a plurality of seams such that each enclosure is joined to an adjacent enclosure by one of said seams.

11. The bag of claim 10, wherein inner and outer wall of each of said enclosures are connected to one another by a pair of said seams.

12. The bag of claim 1, wherein said enclosures are capable of withstanding an inflation pressure in a range of about 12 to about 14 psi.

13. The bag of claim 1, wherein said vertical structure has a height of equal to or less than 1 meter.

14. The bag of claim 13, wherein said enclosures have a height of less than about 150 cm in a non-inflated state.

15. A trash bag comprising:

a floor;

a plurality of inflatable bladders coupled to one another and extending from a proximal end to a distal end, the plurality of inflatable bladders being coupled, at the distal end, to the floor and configured to be, upon inflation, vertically self-supporting around the floor, the plurality of inflatable bladders further being configured to form at least a portion of a perimeter wall of the trash bag;

at least one gas inflation valve fluidly coupled to at least one of said inflatable bladders for introducing a gas into the inflatable bladders; and at least one deflation strip coupled to at least one of the inflatable bladders on an outer surface of the bag and configured to deflate said at least one bladder by generating a hole therein when pulled.

16. The trash bag of claim 15, wherein said trash bag is vertically self-supporting and self-standing without needing a supporting structure, when said inflatable bladders are inflated.

17. The trash bag of claim 15, wherein said deflation strip is coupled to the at least one of the inflatable bladders via a plurality of fused spots.

18. The trash bag of claim 15, wherein said deflation strip is disposed below said inflation valve.

19. The trash bag of claim 15, further comprising a draw string for closing off the trash bag.

20. The trash bag of claim 19, further comprising a channel disposed above said deflation strip for housing said draw string.

21. The trash bag of claim 20, wherein said channel is fused to the distal end of said structure.

22. The trash bag of claim 15, further comprising a gas inflation channel coupled to said gas inflation valve.

23. The trash bag of claim 22, further comprising a plurality of one-way valves each of which is coupled to one of said inflatable bladders for allowing introduction of a gas from said gas inflation channel into said bladders.

24. The trash bag of claim 23, wherein said gas inflation channel is disposed substantially orthogonal to the plurality of gas-filled channels.

25. The trash bag of claim 15, wherein said inflatable bladders are connected to one another by a plurality of seams.

26. The trash bag of claim 15, wherein said inflatable bladders are configured to withstand an operational pressure in a range of about 12 to about 14 psi.

27. The trash bag of claim 15, wherein said inflatable bladders have a height of equal or less than about 1 meter.

* * * * *